United States Patent [19]

Widera et al.

[11] Patent Number: 4,624,186

[45] Date of Patent: Nov. 25, 1986

[54] INFRARED RADIATION-EMITTING DECOY PROJECTILE

[75] Inventors: Axel Widera, Ainring; Alois Schiessl, Bad Reichenhall-Marzoll; Walter Hanser, Bad Krozingen-Tunsel; Peter Rayer; Klaus Hieke, both of Neuenburg, all of Fed. Rep. of Germany

[73] Assignee: Buck Chemisch-Technische Werke GmbH & Co., Bad Überkingen, Fed. Rep. of Germany

[21] Appl. No.: 854,770

[22] Filed: Apr. 23, 1986

[30] Foreign Application Priority Data

Apr. 26, 1985 [DE] Fed. Rep. of Germany ..... 3515166

[51] Int. Cl.[4] ..... F42B 4/26

[52] U.S. Cl. ..... 102/336; 102/334; 102/342; 102/345; 102/357; 102/364; 102/502

[58] Field of Search ..... 102/336, 338, 342, 343, 102/345, 357, 502, 506, 334, 364

[56] References Cited

U.S. PATENT DOCUMENTS

| | | | |
|---|---|---|---|
| 1,366,555 | 1/1921 | Brayton | 102/342 X |
| 3,669,020 | 6/1972 | Waite et al. | 102/364 |
| 3,670,657 | 6/1972 | Evans | 102/336 |
| 3,713,636 | 1/1973 | Helms et al. | 102/336 X |
| 3,940,605 | 2/1976 | Gerber | 102/336 X |
| 4,391,197 | 7/1983 | Jacobsen et al. | 102/357 X |
| 4,463,679 | 8/1984 | Billard et al. | 102/336 |
| 4,474,715 | 10/1984 | Weber et al. | 102/334 X |
| 4,498,392 | 2/1985 | Billard et al. | 102/357 X |
| 4,505,202 | 3/1985 | Fidler et al. | 102/357 X |

*Primary Examiner*—Peter A. Nelson

*Attorney, Agent, or Firm*—Watson, Cole, Grindle & Watson

[57] ABSTRACT

An infrared radiation-emitting projectile includes a casing and a contact head attached thereto, the casing containing an igniter-destructor capsule centrally positioned therein which contains an igniter-destructor charge, a layer of combustible flakes between the igniter-destructor capsule and the side wall of the casing, and an ignition-expediting material such as red phosphorus between the igniter-destructor capsule and the side wall of the casing.

9 Claims, 1 Drawing Figure

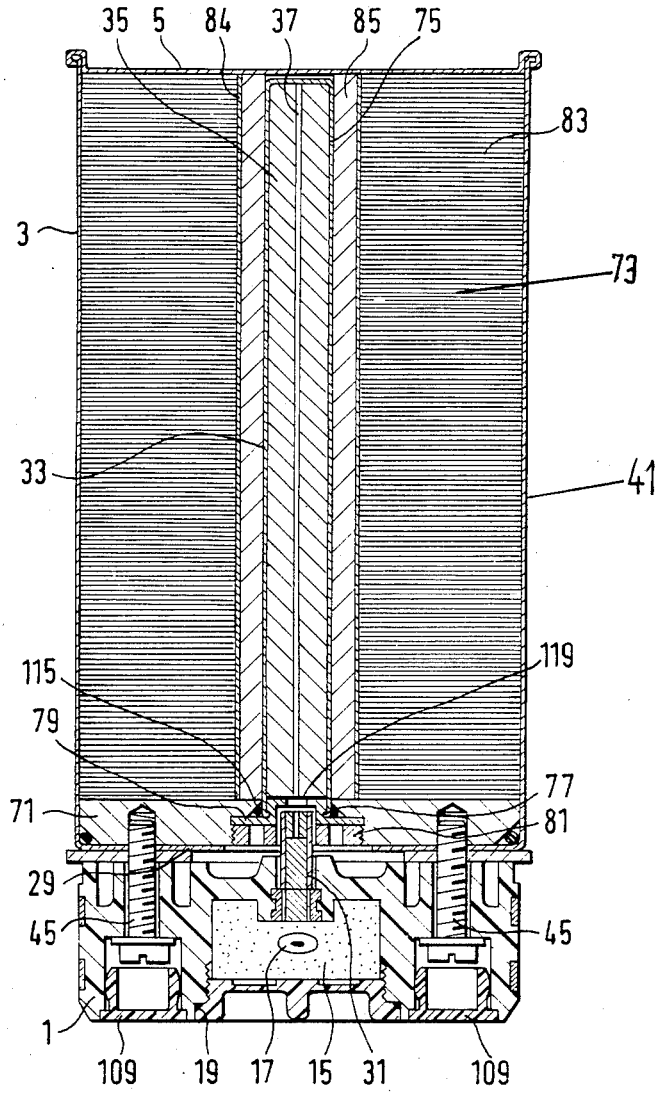
35
5
84
37
85
75
83
3
73
33
41
115
119
79
77
71
81
29
45
45
1
109
19
17
15
31
109

INFRARED RADIATION-EMITTING DECOY PROJECTILE

BACKGROUND OF THE INVENTION

1. Field of the Invention

The present invention relates to decoy projectiles which can be fired into the air and which, after igniting, will emit infrared radiation so as to divert incoming missiles having infrared search heads from their path of travel and away from their intended targets.

2. The Prior Art

Infrared radiation-emitting decoy projectiles are known. These projectiles are, for example, carried on ships so that when the ship's detection instruments detect the approach of an incoming missile equipped with an infrared search head, the projectile can be fired into the air and subsequently, i.e., at a predetermined height and distance from the ship, it will ignite and eject combustible flakes which burn and emit infrared radiation. These combustible flakes will actually form a burning interference cloud which will descend slowly toward the earth and divert the approaching missile(s) toward itself and away from the ship. A projectile of this type is, for example, disclosed in German Pat. No. 28 11 016.

Comprehensive studies have now shown that the infrared radiation of such an interference cloud exhibits a very characteristic radiation emission sequence. Ignition of the igniter-destructor charge in the projectile first results in a "radiation flash," which is radiation of high intensity but which lasts an extremely short time, after which the radiation from the combustible flakes is emitted in such a way that at first there occurs a more or less steep increase in radiation (ignition phase of the combustible flakes) up to a certain maximum (all flakes are burning over their entire surface), followed by constant or insignificantly declining radiation, and then by a more or less sudden decrease of the trailing wave front, i.e., as the combustible flakes stop burning. Between the initial radiation flash and the point at which the combustible flakes emit maximum radiation, there is consequently a "radiation gap" whose duration depends on the steepness of the wave front of the radiation from the combustible flakes. As such, the "radiation gap" is determined by the reaction velocity of the combustible layer of combustible flakes.

Additional studies have now been carried out to ascertain whether and in what way the noted radiation gap can effect the protection offered by the interference cloud. It has been shown that this effect can generally be disregarded when the protection of a medium-sized and medium-fast target is involved, for instance, a torpedo patrol boat. Projectiles for boats of this class are equipped with combustible flakes having a burning time of 10 to 20 seconds, which means a relatively fast-reacting combustible layer and a relatively short radiation gap; moreover, such boats, because of their maneuverability, are protectable by quick, evasive action.

However, when protection of very rapidly moving targets is involved, particularly airplanes, the above-mentioned radiation gap can lead to diminished protection since the distance between the airplane and the radiation cloud increases very rapidly. Although it is possible to overcome this problem by reducing the radiation gap, i.e., by increasing the reaction velocity of the combustible layer of combustible flakes such that its burning period is about five seconds, actual results obtained have not been entirely satisfactory, particularly since, as a result of the high speed of movement of the combustible flakes in relation to the air, even with fast reacting combustible layers there is a delay in the ignition process.

On the other hand, the above-mentioned radiation gap has a negative effect on the protection of very large, slow-moving targets, such as ships of considerable size, although for a very different reason from that of the previously mentioned situation with airplanes. To protect large ships, very early recognition of the approaching missile is necessary, not only because of the low maneuverability of such ships but also because the incoming missile can only be deviated from its course if both the ship and the nearby interference cloud appear in its search field, which is only possible when the missile is still far away from the ship. The requirement of a comparatively early formation of the radiation cloud also means that the radiation time of the cloud must be quite extensive; thus the combustible flakes must, for instance, burn for 30 to 40 seconds. This is only possible when the reaction velocity of the combustible layer is very slow, resulting in a very slow burning process. This leads to such a prolongation of the radiation gap that the timely diversion of the missile can no longer be assured when immediate measures are required, i.e., when the approaching missile is very close to its target when detected. This disadvantage in terms of immediate counter-measures is independent of the size and speed of the target to be protected.

It is, therefore, the object of the present invention to provide an improved infrared radiation-emitting projectile wherein the described radiation gap of the forming radiation cloud is considerably reduced, regardless of whether the combustible layers in the projectile have short, long or very long burning periods.

SUMMARY OF THE INVENTION

In accordance with the present invention, the improved decoy projectile, which includes a casing containing an igniter-destructor charge and a surrounding layer of combustible flakes, also includes an ignition-expediting material located between the igniter-destructor charge (or the ignitor-destructor capsule containing the igniter-destructor charge) and the wall of the casing, the ignition-expediting material being a rapidly reacting material which, on the one hand, emits high-intensity infrared radiation while burning and thus, so-to-speak, extends the radiation flash of the igniter-destructor charge and, on the other hand, ignites the layer of combustible flakes over such a large area that their wave front becomes very steep. The ignition-expediting material is preferably in the form of a packing between the igniter-destructor charge and the layer of combustible flakes. The prolongation of the radiation flash achieved by the invention applies to decoy projectiles containing combustible flakes having all different types of reaction times (fast, medium, slow) and provides an ignition which covers as large an area as possible, and this will be true even for a relatively high speed of movement of the combustible flakes in relation to the surrounding air (prevention of the blow-cut effect). As a result, the situations in which the projectile is usable is considerably enlarged, i.e., it is usable in protecting very fast objects (airplanes) as well as very large objects (large ships), and it is also useful in carrying out immediate defensive actions.

In one embodiment of the invention which is useful with projectiles having particularly slow reacting combustible layers, that is to say layers composed of combustible flakes with extremely flat wave fronts, some of the combustible flakes are replaced with fast burning flakes in order to thereby bridge the radiation gap. This also makes it possible to create a decoy of long duration (30 to 40 seconds) which, at first, has a high radiation output which, after several seconds (e.g. 5 to 10 seconds) decreases to a lower level and then remains constant at that level for an extended period. Moreover, this design also has advantages for immediate measures. It is necessary just for such measures that immediately after creating the interference cloud, the decoy radiates with a particularly high intensity because in such a case the search head of the incoming missile will already be homed in the target and the radiation of the decoy must, therefore, be considerably more intense than that of the real target in order to divert the search head away from the latter and toward the decoy. Such radiating behavior will in turn be made possible through a mixture of rapidly burning (high radiation intensity) and slow-burning (low radiation intensity) flakes.

DESCRIPTION OF THE FIGURE

The invention will now be better understood by reference to the attached FIGURE and the following discussion, the attached FIGURE showing a vertical section through a projectile in accordance with a preferred embodiment of the invention.

DETAILED DESCRIPTION OF THE PREFERRED EMBODIMENT

The projectile depicted in the FIGURE includes a contact head 1 which is connected to a casing 3 by screws 45 that extend through peripheral bores 1*a* in the contact head and threadingly engage in blind bores in a mounting plate 71 positioned in the lower end of the casing 3. The lower ends of the peripheral bores 1*a* are tightly sealed by protective covers 109. The contact head 1 has a central chamber 1*b* that contains an ejection charge 15 and passages (not shown) which enable sealed wires and coupling pins (not shown) to electrically connect external contacts 1*c* extending around the external side of the contact head to an ignition pellet 17 embedded in the ejection charge 15. The central chamber 1*b*, which is threaded at its lower end, is sealed by a screw cover 19 that has a window-like area 19*a* of reduced thickness (the area 19*a* exhibits a predetermined breaking strength) and a web-like rib area 19*b* (for the spacing piece of a cup discharger). A threaded central bore 1*d* is provided between the chamber 1*b* and the upper end of the contact head, and positioned in this central bore is an elongated time-delay ignition charge 31. The elongated time-delay ignition charge extends beyond the upper end of the contact head and into an open area 71*a* in the center of the mounting plate 71 (the open area 71*a* in the mounting plate 71 has a lower portion which is threaded and an upper portion which is not, the lower portion having a larger diameter than the upper portion). The contact head 1, the screw cover 19 and the protective covers 109 are all made of pressure-molded polystyrene.

The casing 3 is in the form of a can whose upper end is open and whose bottom end has a central opening therein through which the time-delay ignition charge 31 can extend. A cover 5 is sealingly attached to the open upper end of the casing 3 via interlocking flanges. The casing 3 contains the mounting plate 71 at its lower end and has an igniter-destructor unit 33 centrally positioned therein which extends from the cover 5 to the mounting plate 71. This unit 33 consists of a first tubular capsule 75 which contains an ignition core 37 and a surrounding destructor charge 35. The ignition core 37 is composed of small, aligned nitrocellulose powder tubes which have inner diameters of 0.2 mm and outer diameters of 1.3 mm. The lower end of capsule 75 extends into the central open area 71*a* in mounting 71 and has an inwardly flanged edge 77 which grips a cover disc 79 which is positioned in the open area in mounting plate 71. A lock screw 81 extends upwardly into the lower portion of the open area 71*a* and presses cover disc 79 against the contact head. A ring seal 115 located between the contact head and the cover disc helps seal the lower end of the capsule 75. The cover disc 79 includes a central bore hole which is covered by a foil 119 (preferably tin foil) which is glued thereto, this foil providing a barrier between the igniter-destructor charge 35 in the capsule 75 and the time-delay ignition charge 31. The casing 3, the capsule 75, the cover 5 and the mounting 71 are all made of aluminum, and the casing 3, the capsule 75 and the cover 5 all have wall thicknesses of about 0.25 mm.

The casing 3 also contains a second tubular capsule 84 which surrounds the first capsule 75, this second capsule having an extremely thin wall. Between the second tubular capsule 84 and the side wall 41 of the casing 3 is a tubular packing of an ejection material 73, i.e., a layer of combustible flakes 83, which are individually shaped as segments of a circle. Between the second capsule 84 and the first capsule 75 is an annular space filled with a tubular packing of ignition-expediting material 85, preferably loosely-packed red phosphorus.

The combustible flakes 83 are preferably made of a base material such as paper which has an incendiary paste pressed thereon, the incendiary paste containing red phosphorus and a suitable binder, e.g., 90% by weight red phosphorus and 10% binder. The greater the ratio of red phosphorus to binder the faster the combustible flakes will burn. The incendiary paste can also contain, for example, aluminum hydroxide to slow its burn time, the greater the amount of aluminum hydroxide the slower the burn time. Combinations of combustible flakes having different types of incendiary paste can also be used to control the reactiveness and burn time of the layer of combustible flakes.

The inventive projectile functions like known projectiles, except that when the igniter-destructor charge 35 is ignited, it ignites ignition-expediting material 85 which, during its short burning period, emits infrared radiation of considerable intensity and, simultaneously, ignites combustible flakes 83 over a wide area. The ignition of combustible flakes 83 over a wide area occurs because a fire ball is created around the projectile as a result of the combustion of ignition-expediting material 85, which passes through the combustible flakes 83 in flight. Thus, combustible flakes 83 also ignite quickly and over a large area, even when the incendiary paste of the combustible flakes is very slow-reacting, for instance, when rendered passive or when covered by a passivated layer.

With reference to the noted uniform ignition of all combustible flakes over a large area, it is also significant that the igniter-destructor charge reacts evenly throughout its entire length in order to thereby allow the ignition-expediting material to become effective all around and along its entire length. This is expedited by the ignition core made of nitrocellulose powder which is placed in the center of the igniter-destructor charge and which, because of its highly combustible nature, its high burning speed, and its gas-separating effect during the combustion phase, has a stabilizing effect on the rapid burning process. Without this combustion stabilizer there would be the danger that fluctuations in the reaction velocity could occur, due to defective sealing, for instance, resulting from improper manufacture or from vibrations occurring during transport.

By proportioning mass and reactiveness of the ignition-expediting material 85 and the reaction velocity of the combustible layer of combustible flakes 83, if necessary by mixing slow-and fast-burning flakes, it is possible to considerably shorten the radiation gap after the radiation flash of the igniter-destructor charge 35 or to bridge it completely, and independently of the total burning time of the decoy. In this manner all initially-mentioned cases of protecting a target can be accommodated.

The invention is obviously not restricted to the specific projectile construction as shown in the FIGURE. For instance, the second capsule 84 is not absolutely necessary; ignition-expediting material 85 can instead be located in the tubular space between capsule 75 and the layer of combustible flakes 83. Another possibility is to pack combustible flakes 83 from the capsule 75 to the side wall 41 (thereby eliminating the tubular space) and to distribute the ignition-expediting material 85 onto the combustible flakes as a dust or to apply it thereon as a layer. Finally, it is also possible to use a material other than red phosphorus as the ignition-expediting material; however, red phosphorus is preferred because it is generally also a component of the combustible flakes 83.

We claim:

1. In a decoy projectile which can be fired into the air and when ignited will emit infrared radiation so as to divert a missile with an infrared search head from its path of travel and away from a target, said projectile including a can-shaped casing having a side wall and a first end which is open; an electrically-activated contact head attached to said second end of said casing; a cover sealingly attached over said open first end of said casing; an igniter-destructor unit centrally positioned within said casing and operatively associated with said contact head, said igniter-destructor unit including an igniter-destructor capsule containing an igniter-destructor charge, and a layer of combustible flakes positioned between said igniter-destructor unit and said side wall of the casing, the improvement wherein said projectile includes an ignition-expediting material between said igniter-destructor unit and said side wall of said casing.

2. The decoy projectile as defined in claim 1, wherein said layer of combustible flakes comprises combustible flakes having differing types of incendiary pastes and which burn at varying intensities.

3. The decoy projectile as defined in claim 2, wherein some of said combustible flakes include an incendiary paste which contains aluminum hydroxide.

4. The decoy projectile as defined in claim 1, wherein said ignition-expediting material consists of pulverized red phosphorus.

5. The decoy projectile as defined in claim 1, wherein said ignition-expediting material is distributed throughout said combustible flakes as a powder.

6. The decoy projectile as defined in claim 1, wherein said ignition-expediting material covers said combustible flakes as a layer.

7. The decoy projectile as defined in claim 6, wherein said igniter-destructor unit is tubular in shape, wherein said layer of combustible flakes is in the form of a tubular packing, and wherein said ignition-expediting material is in the form of a tubular packing located between said tubular igniter-destructor unit and said tubular packing of combustible flakes.

8. The decoy projectile as defined in claim 7, including a thin-walled tube positioned between said tubular packing of igniter-expediting material and said tubular packing of combustible flakes.

9. The decoy projectile as defined in claim 1, including a core of aligned nitrocellulose tubes within said igniter-destructor charge in said igniter-destructor capsule, said nitrocellulose tubes acting as a burning stabilizer.

* * * * *